US005478125A

United States Patent [19]

Gromotka

[11] Patent Number: 5,478,125

[45] Date of Patent: Dec. 26, 1995

[54] DRAW LATCH WITH CATCH HAVING KICK-OUT ACTION

[75] Inventor: Gabriel Gromotka, Caledonia, N.Y.

[73] Assignee: Southco, Inc., Concordville, Pa.

[21] Appl. No.: 257,089

[22] Filed: Jun. 9, 1994

[51] Int. Cl.[6] ..... E05C 5/00

[52] U.S. Cl. ..... 292/67; 292/113; 292/DIG. 49

[58] Field of Search ..... 292/67, 113, 247, 292/DIG. 49, DIG. 60

[56] References Cited

U.S. PATENT DOCUMENTS

| | | | |
|---|---|---|---|
| 3,534,992 | 10/1970 | Swanson | 292/247 |
| 3,954,293 | 5/1976 | Orr | 292/DIG. 49 |
| 4,053,177 | 10/1977 | Stammreich et al. | 292/DIG. 60 |
| 4,307,906 | 12/1981 | Schenk | 292/247 |
| 4,352,513 | 10/1982 | Gunther | 292/113 |
| 5,165,148 | 11/1992 | Fleischer et al. | 292/113 |

*Primary Examiner*—Peter M. Cuomo
*Assistant Examiner*—Monica E. Millner
*Attorney, Agent, or Firm*—Paul & Paul

[57] ABSTRACT

A draw latch includes a handle assembly comprising a base, a lever and a catch. The handle assembly is mounted on a first panel and is adapted for fastening a keeper mounted on a second panel. When the latch is fastened, the catch engages the keeper which operates to draw the panels together. When the latch is unfastened, rotation of the lever provides corresponding rotation or "kick-out" of the catch from engagement with the keeper.

14 Claims, 2 Drawing Sheets

DRAW LATCH WITH CATCH HAVING KICK-OUT ACTION

BACKGROUND OF THE INVENTION

1. Field of the Invention

The present invention relates generally to latches for fastening doors, panels and the like and more particularly to draw latches having the components of a base, a lever and a catch, with the catch being adapted for engaging a keeper in a fastened position.

2. Description of the Prior Art

A common type of fastener known in the art adapted for securing panel members and the like are draw latches. Draw latches essentially are comprised of a handle assembly and a keeper. The handle assembly generally includes the components of a base, a lever and a catch, with the base and lever being pivotally connected to each other, and with the catch and lever being pivotally connected to each other. In operation, the handle assembly is adapted to be mounted onto a first panel member and the keeper is adapted to be mounted on a second panel member and is designed to receive the catch for latching. Generally, when the catch engages the keeper, a downward force is applied to the lever which causes the catch to pull the panels together and into a fastened position. In essence, the latching action is achieved by rotating the lever to shift the pivotal connection of the catch and the lever in relation to a line extending between the keeper and the point of pivotal connection of the lever and base. In general, there are two distinct latching actions for such latches; namely over-center and under-center. An over-center action provides the pivot connection of the lever and the catch below the center line between the base and the keeper when in the fastened position. With respect to an under-center action, the pivot of the lever and the catch is positioned above the center line of the base and the keeper when fastened. For unlatching, an upward force is applied to the lever in order to provide rotation of the lever in the direction opposite that for latching. A disadvantage with conventional draw latches however is that following rotation of the lever for unlatching, the catch must be manually raised in order to be disengaged from the keeper. One type of draw latch is known that incorporates a spring which automatically raises or provides "kick-out" of the catch from the keeper when unlatched. However, a major problem with this type of draw latch is that the movement of the catch cannot be controlled. For example, the spring operates to force the catch from the keeper in all instances, even those where such action is not desired or otherwise required. Furthermore, the rate of rotation of the catch from the latched position cannot be varied in such latches, for instance, in some situations it may be desired to regulate the outward movement of the panel members by the operation of the catch. In addition, such latches are relatively complex to manufacture and in many instances the spring can become overstressed after prolonged use of the latch.

The present invention has been developed in view of the foregoing and to overcome the deficiencies of the prior art.

SUMMARY OF THE INVENTION

The present invention provides a draw latch adapted for use in securing opposing panel members. In accordance with the present invention, a latch is disclosed which includes a keeper adapted for fastening to a first panel member and a handle assembly. The handle assembly includes a base adapted for fastening to a second panel member, a lever and a latching member. The lever is rotatably mounted on the base and is adapted to rotate between an open and a closed position. The latching member is rotatably mounted on the lever between an open and a closed position. The latching member is adapted for being fastened with the keeper when the latching member and the lever are in the closed positions. When the lever is in the closed position, the center of rotation of the lever is closer to the keeper than is the center of rotation of the latching member. The lever also includes a camming member for rotating the latching member from the closed position to the open position when released from being fastened with the keeper. The camming member is adapted to engage the latching member as the lever is rotated a predetermined amount from the closed position to a partially open position. Continued rotation of the lever to the open position past the partially open position provides rotation of the latching member by the camming member from the closed position to the open position.

An object of the present invention is to provide a novel draw latch having a base, a lever and a latching member, with the latching member being adapted for engaging a keeper in a fastened position.

In addition, an object of the present invention is to provide a draw latch that provides kick-out of the latching member from engagement with the keeper when released from the fastened position.

Another object of the present invention is to provide a draw latch having controlled kick-out action of the latching member when released from engagement with the keeper.

Yet another object of the present invention is to provide a draw latch having kick-out action of the latching member in which the parts are few and is durable in use.

These and other objects of the present invention will become more readily apparent from the following description.

DETAILED DESCRIPTION OF THE PREFERRED EMBODIMENTS

Figure 2:
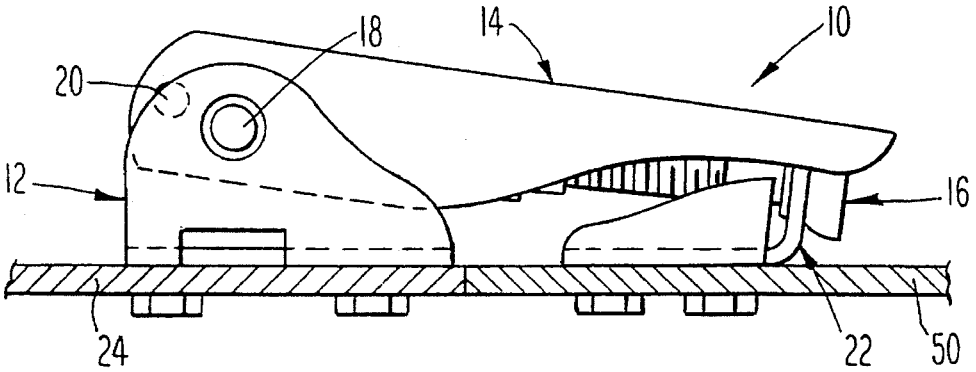
FIG. 2 is a side elevational view of the draw latch of FIG. 1.
Figure 1:
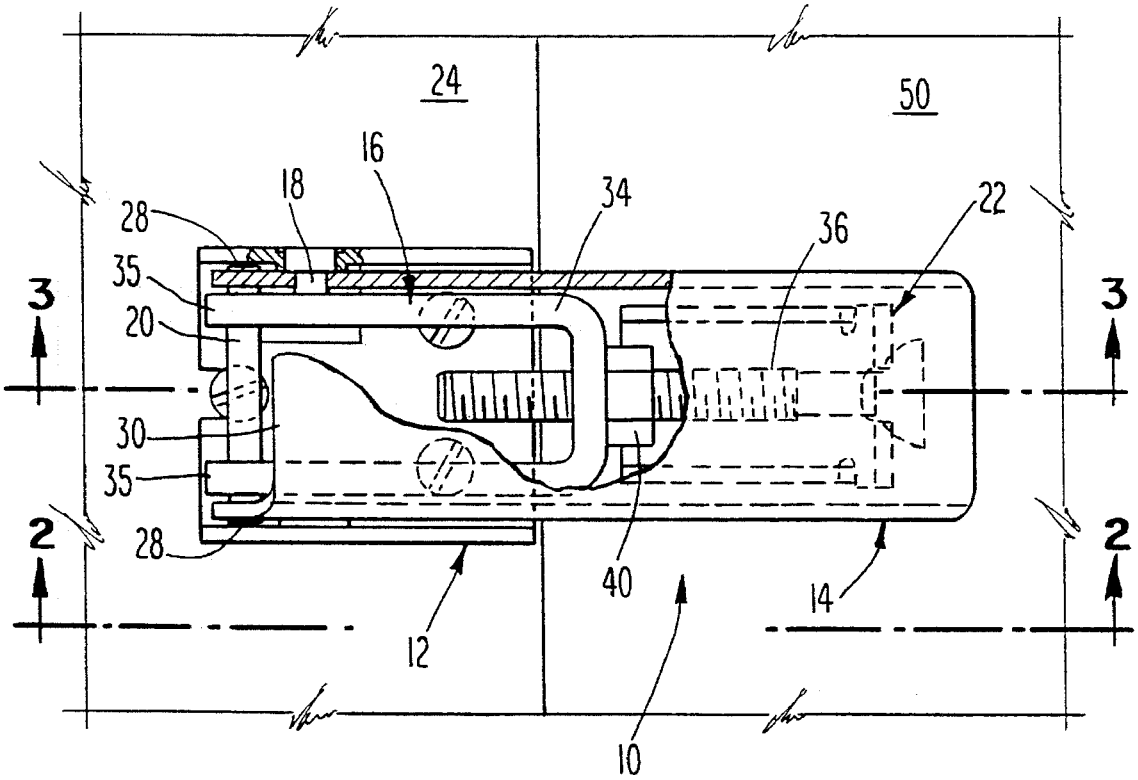
FIG. 1 is a partially cut away top plan view of a draw latch of the present invention shown in a closed position.

Referring now to the drawings in detail, wherein like reference numerals indicate like elements throughout the several views, there is shown in FIG. 1 a top view and in FIG. 2 a side view of a draw latch 10 in accordance with the present invention. The draw latch 10, as illustrated, is of the under-center type indicated above, however it is to be understood that the present invention as will be described in detail below can have application with other types of draw latches, such as of the over-center type indicated above, as well as other latch configurations known in the art.

The draw latch 10, as shown, includes a base 12, a lever 14 and a latching member or catch 16. The lever 14 is rotatably mounted on the base 12 preferably by a pair of pins 18 or other suitable fastening means. The catch 16 is in turn rotatably mounted on the lever 14 by a pin 20 or other suitable fastening means commonly known in the art. A keeper 22 is also provided in engagement with the catch 16.

The base 12 is a generally U-shaped member and includes a substantially planer bottom surface which is adapted to contact a panel, door or the like, such as the panel member 24 shown in the figures. In the present embodiment, the bottom surface of base 12 includes a pair of adjacent, substantially cylindrical bores therethrough which are adapted for receiving two corresponding screw members for being secured to the panel member 24. However, it should be understood that any other fastening means can also be provided for this purpose without departing from the spirit of the present invention, such as double sided adhesive or rivet members. In addition, a pair of diametrically opposing, substantially cylindrical bores are provided in the side portions of the base 12 for receiving the pins 18 for connection of the lever 14. In the present embodiment, the lever 14 can be mounted in the position illustrated in the figures or, alternatively, mounted to extend out from the opposite end of the base 12, which would operate to provide a portion of the bottom surface visible when in the position illustrated in FIG. 1. Further, raised annular bearing members 28 are also provided extending from the bores through the side portions of the base 12 which engage the lever 14 when rotated to the position illustrated in FIG. 1.

The lever 14 as shown is a generally elongate member including a top wall and a pair of opposing downwardly extending sidewalls. A pair of diametrically opposing substantially cylindrical bores are provided in the lever 14 proximate a first end 30 which are adapted to receive the pins 18 for connection on the base 12. As illustrated in the figures, the first end 30 of the lever 14 which comprises a camming means is adapted to engage the catch 16 as the lever is rotated from a closed position illustrated in FIG. 3 to an open position illustrated in FIG. 4. In the present embodiment, as best seen in FIG. 1, the top wall provides a substantially planer surface at the first end 30 of the lever 14 which is adapted to engage the catch 16, as shown in dotted line in FIG. 4, from a non-engaged position which is shown in FIG. 1, for the purpose hereinafter described, however, it should be understood that any other suitable configuration of the top wall of lever 14 can be provided for the same purpose. A second pair of diametrically opposing substantially cylindrical bores are also provided in the side walls of lever 14. In the present invention, the second pair of bores are provided in the lever 14 closer to the first end 30 than the bores adapted for receiving the pins 18. The second pair of bores are adapted to receive the pin 20 for mounting of the catch 16. As illustrated in the present embodiment, the length of pin 20 is slightly greater than that extending between the two opposing second bores. In this manner, the pin 20 extends slightly outward from the outer wall of the lever 14 forming the bearing members 28, which provides frictional resistance through engagement of the sidewalls of the base 12 when the lever 14 is rotated between the positions illustrated in the figures.

The catch 16 as illustrated is a generally elongate member. The catch 16 in the present embodiment includes a generally U-shaped bracket member 34 and a latch 36, however, other configurations can also be provided for this purpose. The U-shaped bracket member 34 is provided with a pair of diametrically opposing cylindrical bores provided proximate each end 35 thereof which receives the pin 20 for mounting to the lever 14. The bracket member 34 is further provided with a threaded opening provided through the bottom portion thereof for receiving the latch 36. In the present embodiment, the latch 36 as shown comprises a bolt member having a threaded section thereon for being received within the threaded opening of the bracket member 34, and also includes a driver receiving recess on its distal end (not shown). It should be understood however that the latch 36 can be of any configuration known in the art for the same purpose, such as a hook or similar. The latch 36 is further shown with a nut 40 mounted thereon which is adapted to fix the lateral position thereof relative to the bracket member 34. In particular, the position of the latch 36 can be adjusted by rotation of the distal end via a suitable configured driver engaging the recess thereof, such as a phillips head screwdriver in the present embodiment, and the nut 40 is then rotated to secure the latch 36 in its adjusted position. In this manner, the latch 36 is adapted to engage with the keeper 22 when in the closed position illustrated in FIGS. 1 and 2. In accordance with the present invention, each end 35 of the U-shaped bracket member 34 comprises the portion of the catch 16 noted above which is configured to engage the top wall of the lever 14 of the first end 30, which comprises the camming means, as the lever 14 is rotated about pin 2 in the manner illustrated in FIG. 4. In the present embodiment, each end 35 of the U-shaped bracket member 34 is provided with generally arcuate shaped portions extending therefrom.

Figure 5:
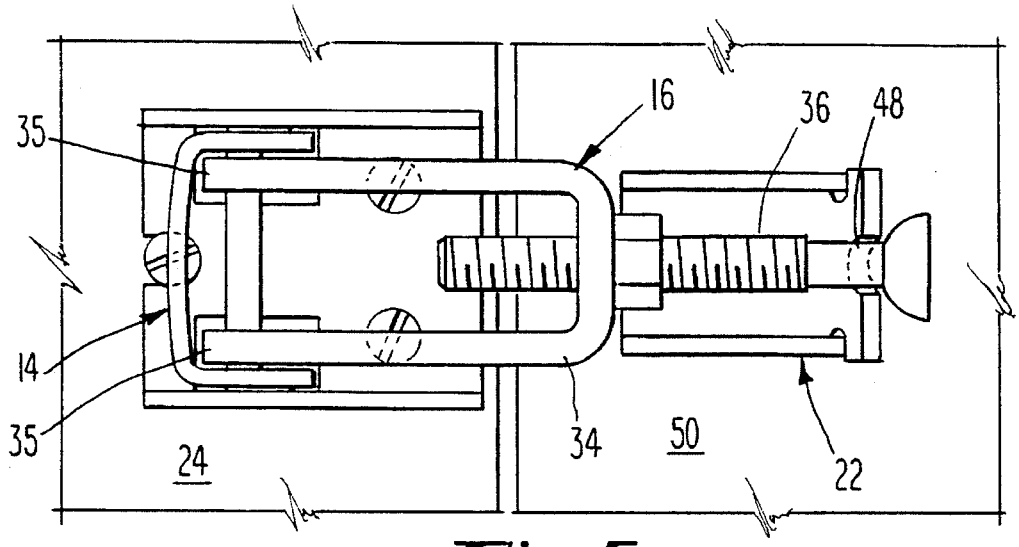
FIG. 5 is a top plan view of the draw latch of FIG. 4 illustrating the lever in the 90° open position.

The keeper 22 as shown is generally U-shaped and includes an upwardly extending end wall with a generally arcuate slot 48 provided therein, as best seen in FIG. 5. The keeper 22 is further included with a pair of adjacent substantially cylindrical bores provided through its bottom surface for receiving a screw or other suitable member for engaging a panel member 50, similar to the base 12 indicated above. As illustrated in FIG. 1, the latch 36 is adapted to engage the generally arcuate slot 48 for fastening of the draw latch 10.

Figure 3:
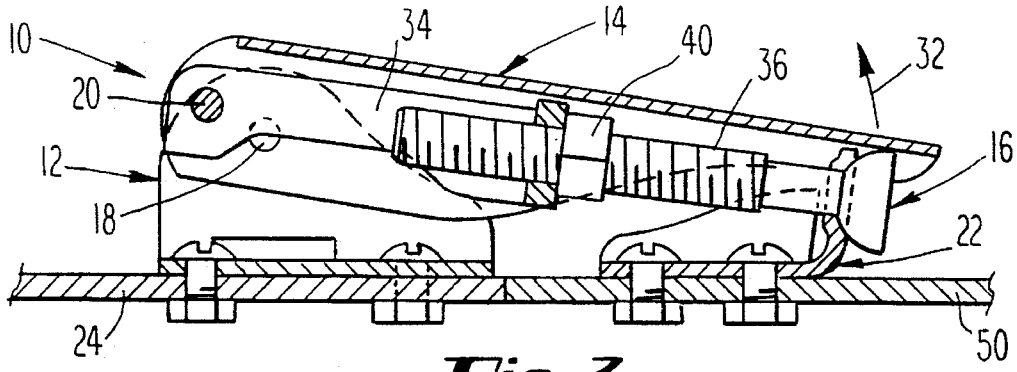
FIG. 3 is a sectional side elevational view of the draw latch of FIG. 2.
Figure 4:
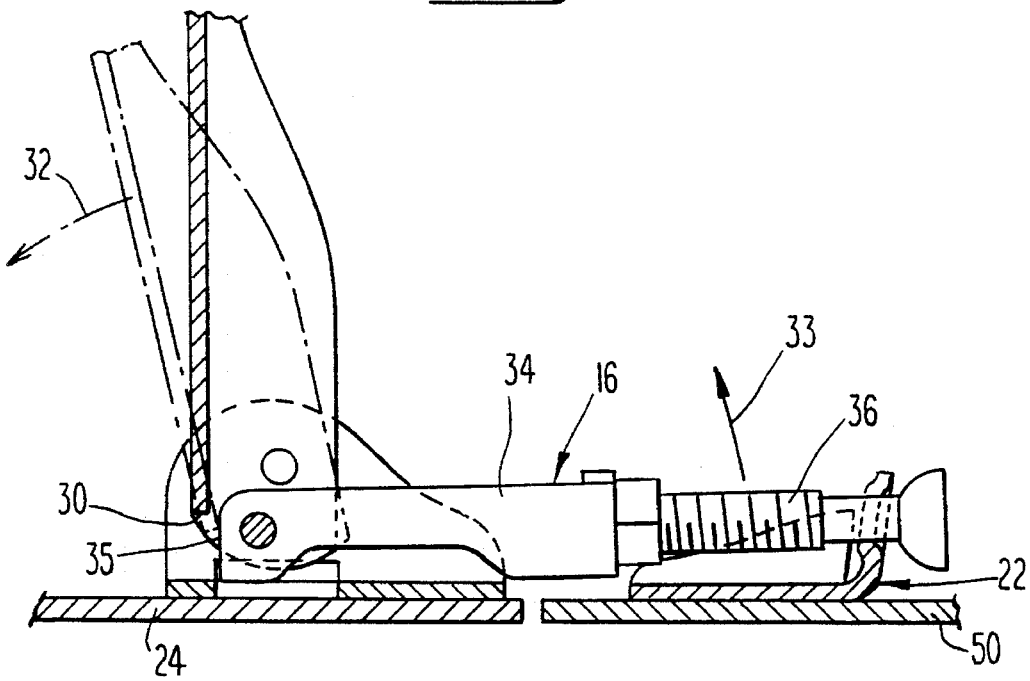
FIG. 4 is a sectional side elevational view of the draw latch of FIG. 3 and illustrating the lever of the present invention in a 90° open position and in dotted line in a position engaging the catch thereof.

The operation of the draw latch of the present invention is most clearly illustrated in FIGS. 3 through 5. Generally, as the panels 24 and 50 are first being latched, the catch 16 is rotated in a clockwise direction into a position engaging the generally arcuate slot 48 of the keeper 22. In particular, when the lever 14 is rotated clockwise around the pins 18, the catch 16 is rotated initially to engage and then is moved laterally in a direction of the base 12, which forces the panels 24 and 50 together through the engagement of the distal end of latch 36 with the keeper 22. When the lever 14 is in the closed position as shown in FIG. 3, the draw latch 10 is fully fastened, with the panels 24 and 50 being tightly drawn together. In this closed position, the pins 18 (which supports the lever 14 to the base 12) are closer to the keeper 22 than the pin 20 (which supports the catch 16 to the lever 14). Furthermore, the pin 20 when in the closed position is positioned above a center line extending between the keeper 22 and the pins 18. As indicated above, this configuration provides an under-center latching action in relation to panel members 24 and 50. As the draw latch 10 is unfastened, the lever 14 is rotated in a counter-clockwise direction shown by arrow 32 around the pins 18. As illustrated in FIGS. 3 through 5, the rotation of the lever 14 from the closed position initially provides lateral movement of the catch 16 in the direction of the keeper 22 as the lever 14 is rotated around pin 20. This lateral movement of the catch 16 preferably allows the panel members 24 and 50 to move apart from the drawn in position as is shown in FIGS. 4 and 5. In accordance with the present invention, the extent of lateral movement of the catch 16 corresponds to a predetermined degree of rotation of the lever 14 from the closed position to the position illustrated in dotted line shown in FIG. 4. In the present embodiment, the angle of rotation of the lever 14 from the closed position is approximately 120° to the dotted line position of FIG. 4, however it should be understood that any desired angle of rotation can be provided without departing from the spirit of the invention, for example, 60°, 90°, etc. As illustrated in FIG. 1, the first end 30 of lever 14, which comprises the camming means, is at spaced separation from and not in engagement with the ends 35 of the catch 16. However, as the lever is rotated counter clockwise to the position illustrated in dotted line in FIG. 4, the distance between the first end 30 of the lever 14 and the ends 30 of the catch 16 decrease due to the rotation of the lever 14 relative to the catch 16 about the pin 20. The lever 14 when in the 120° rotated position illustrated in FIG. 4 is adapted to have its first end 30, via the top wall, come into contact with the catch 16, by engaging the ends 35 of the U-shaped bracket member 34, as is described above. From this position illustrated, continued counterclockwise rotation of the lever 14 to the open position provides corresponding rotation of the catch 16 in the direction of arrow 33 away from the keeper 22 via the engagement of the ends 30 of the catch 16 with the first end 30 of the lever 14. Based on the foregoing description, it will be understood that the present draw latch is adapted to raise or "kick-out" the catch 16 from engagement with the keeper 22 when the latch is opened from a fastened position. In particular, the rotation of the lever 14 will coincide with corresponding rotation of the catch 16 by the camming action of the first end 30 of the lever 14.

In view of that described above, it will be understood that the present invention possesses several advantages over conventional latches. In particular, a latch is provided that is adapted to kick-out the catch away from the keeper when the latch is unfastened and also allows the catch to be maintained in a raised position when unlatched. In addition, the kickout movement of the catch can be controlled via the rotation of the lever. Further, few components are necessary and the components are durable in use, which leads to reduction in cost of manufacture and inventory, as well as overall life span of the product. In addition, the components can be manufactured relatively inexpensively of a variety of standard materials, such as of sheet metal, and by a number of conventional techniques, such as by cutting and bending and/or molding as examples.

It will be recognized by those skilled in the art that changes may be made by the above-described embodiments of the invention without departing from the broad inventive concepts thereof. For example, the lever 14 can also be provided with an opening extending therethrough for receiving a catch or hasp portion mounted on the catch 16. In particular, the catch and hasp portions can comprise conventional members of this type adapted for securing the lever 14 in the closed position. In addition, the latch 36 can be provided with a spring member thereon adapted for providing additional resistance with the keeper 22. In particular, the spring can be of the helical type and provided on the latch 36 within the portion extending within the U-shaped bracket member 34 and secured thereon by a nut or similar on the end thereof. Furthermore, in some instances, e.g., improper application, the panels 24 and 50 as the catch 16 is moved laterally from the fastened position could remain in a drawn in position rather than move apart from one another. In this particular situation, in the present embodiment, the catch 16 as it is moved laterally will also be rotated slightly upward from its closed position within the keeper 22 due to its engagement with the U-shaped keeper side walls. In particular, the mounting bracket 34 of the catch 16 will ride-up on the U-shaped keeper side walls as the catch 16 is laterally moved in the direction of the keeper 22. However, it should be understood that such will not occur when a different configuration of keeper 22 and/or catch 16 are employed that avoid engagement of these members in such a situation. It is understood, therefore, that this invention in not limited to the particular embodiments disclosed, but it is intended to cover all modifications which are within the scope and spirit of the invention as defined by the appended claims.

I claim:

1. A latch comprising:

a keeper adapted for fastening to a first panel member; and a handle assembly, the handle assembly including:

a base adapted for fastening to a second panel member;

a lever rotatably mounted on said base and adapted to rotate between an open and a closed position; and a latching member rotatably mounted proximate a first end thereof on said lever, said latching member having a second end being rotatable between an open and a closed position and adapted for being fastened with said keeper when said latching member and said lever are in said closed positions, wherein when said lever is in said closed position the center of rotation of said lever is closer to said keeper than is the center of rotation of said latching member;

said lever further including camming means for rotating said second end of said latching member from the closed position to the open position when released from being fastened with said keeper, wherein said camming means is at spaced separation from said latching member in the closed position defining a non-engaged position and engages said latching member from said non-engaged position through rotation of said lever about said latching member as said lever is rotated a predetermined amount about said base from the closed position to a partially open position, wherein a continued amount of rotation of said lever about said base to the open position past said partially open position provides an amount of rotation of said latching member by said camming means from the closed position to the open position substantially equivalent to said continued amount of rotation of said lever.

2. A latch according to claim 1, wherein said camming means of said lever is independent the rotational connection of said lever with said latching member.

3. A latch according to claim 2, wherein said camming means comprises a generally planar end wall provided at a first end of said lever for engaging said latching member, wherein the rotational connection of said lever with said latching member is proximate said first end of said lever.

4. A latch according to claim 1, wherein said latching member includes at least a first area thereon proximate the rotational connection with said lever adapted for engaging said camming means.

5. A latch according to claim 4, wherein the latching member includes at least a second area thereon proximate both the rotational connection with said lever and the at least a first area thereon adapted for engaging said camming means corresponding to substantially when said at least a first area of said latching member is in engagement with said camming means.

6. A latch according to claim 5, wherein said latching member includes a generally U-shaped portion rotatably mounted to said lever proximate each end of said generally U-shaped portion, said generally U-shaped portion having said at least a first and second areas thereon proximate each end thereof for engaging said camming means.

7. A latch according to claim 6, wherein said latching member further includes a latch connected to said U-shaped portion adapted for engaging said keeper.

8. An under-center latch assembly adapted for fastening first and second panel members, the latch assembly comprising a keeper adapted for fastening to the first panel member and a handle assembly adapted for fastening to the second panel member, the handle assembly including:

a base adapted for fastening the handle assembly to the second panel member;

a generally elongate lever rotatably mounted proximate a first end thereof on said base and having a second end adapted for being rotated between an open and a closed position;

a generally elongate latching member having a first end and a second end and being rotatably mounted proximate the first end thereof on said lever for either rotational or lateral movement with respect thereto, wherein said rotational movement of said second end of said latching member is between an open and a closed position, said latching member being adapted for fastening with said keeper when said latching member and said lever are rotated in said closed positions, wherein when said lever and said latching member are in said closed positions, both the center of rotation of said lever is closer to said keeper than is the center of rotation of said latching member and said second end of said latching member is closer to the second end of said lever than is the first end of said latching member;

said lever further including camming means for rotating said second end of said latching member from the closed position to the open position when released from being fastened with said keeper, wherein said camming means is at spaced separation from said latching member in the closed position defining a non-engaged position and engages said latching member from said non-engaged position through rotation of said lever about said latching member as said lever is rotated a predetermined amount about said base from the closed position to a partially open position, wherein a continued amount of rotation of said lever about said base to the open position past said partially open position provides an amount of rotation of said latching member by said camming means from the closed position to the open position substantially equivalent to said continued amount of rotation of said lever, wherein when said latching member is in the closed position, rotation of said lever between the closed position and the partially open position thereof provides said lateral movement of said latching member and rotation of said lever between the partially open position and the open position thereof provides said rotational movement of said latching member.

9. A latch according to claim 8, wherein said camming means of said lever is proximate the first end thereof.

10. A latch according to claim 9, wherein said camming means comprises a generally planar end wall provided at the first end of said lever for engaging said latching member.

11. A latch according to claim 8, wherein said latching member includes at least a first area thereon proximate the first end thereof adapted for engaging said camming means.

12. A latch according to claim 11, wherein said latching member includes at least a second area thereon proximate both the first end of said latching member and the at least a first area thereon adapted for engaging said camming means corresponding to substantially when said at least a first area of said latching member is in engagement with said camming

13. A latch according to claim 12, wherein said latching member includes a generally U-shaped portion rotatably mounted to said lever proximate each end of said generally U-shaped portion, said generally U-shaped portion having said at least a first and second areas thereon proximate each end thereof for engaging said camming means.

14. A latch according to claim 13, wherein said latching member further includes a latch connected to said U-shaped portion adapted for engaging said keeper.

* * * * *